US007624952B1

(12) United States Patent
Bartek

(10) Patent No.: US 7,624,952 B1
(45) Date of Patent: Dec. 1, 2009

(54) SAFETY SYSTEM FOR RAILROAD PERSONNEL

(76) Inventor: Peter M. Bartek, 9 Old Traveled Way, Ledgewood, NJ (US) 07852

( * ) Notice: Subject to any disclaimer, the term of this patent is extended or adjusted under 35 U.S.C. 154(b) by 0 days.

(21) Appl. No.: 12/150,706

(22) Filed: May 1, 2008

Related U.S. Application Data

(63) Continuation-in-part of application No. 11/820,317, filed on Jun. 19, 2007, now abandoned, which is a continuation-in-part of application No. 11/732,530, filed on Apr. 4, 2007, now abandoned.

(60) Provisional application No. 60/789,279, filed on Apr. 4, 2006, provisional application No. 60/815,425, filed on Jun. 21, 2006.

(51) Int. Cl.
*B61L 25/00* (2006.01)

(52) U.S. Cl. ..... 246/124; 246/477; 246/488; 246/167 A

(58) Field of Classification Search ..... 246/488, 246/122 R, 124, 167 A, 477, 473 R, 473.1, 246/187 A; 340/903, 573.1, 539.22
See application file for complete search history.

(56) References Cited

U.S. PATENT DOCUMENTS 5,727,758 A * 3/1998 Penza et al. ..... 246/124
6,113,037 A * 9/2000 Pace ..... 246/124
6,145,792 A * 11/2000 Penza et al. ..... 246/167 A

FOREIGN PATENT DOCUMENTS

JP 2007-176470 * 7/2007

OTHER PUBLICATIONS

Copending U.S. Appl. No. 11/820,317, filed Jun. 19, 2007.*

* cited by examiner

*Primary Examiner*—Mark T Le
(74) *Attorney, Agent, or Firm*—William Nitkin

(57) ABSTRACT

A system for use by a railroad to warn railroad workers, track walker, railroad personnel and others of oncoming train(s) and to warn the train operator(s) of such train(s) of the presence of railroad workers, track walker railroad personnel, other train(s) and others on or near the railroad tracks, such system including at least one train transceiver for each train for sensing signals transmitted by at least one of a plurality of personal transmitter/receivers, one personal transmitter/receiver being worn by each of such railroad workers, track walker and railroad personnel, such train transceiver(s) to warn the train operator(s) of the presence of railroad workers, track walker, other train(s), and railroad personnel on or near the tracks when receiving signals from the personal transmitter/receivers, such personal transmitter/receivers receiving signals from the train transceiver(s) to warn the railroad workers, track walker and railroad personnel of oncoming train(s) with such warning signal activating nearby lights and horns, such system working in conjunction with VOBC and a compact, lightweight portable train detectors.

2 Claims, 1 Drawing Sheet

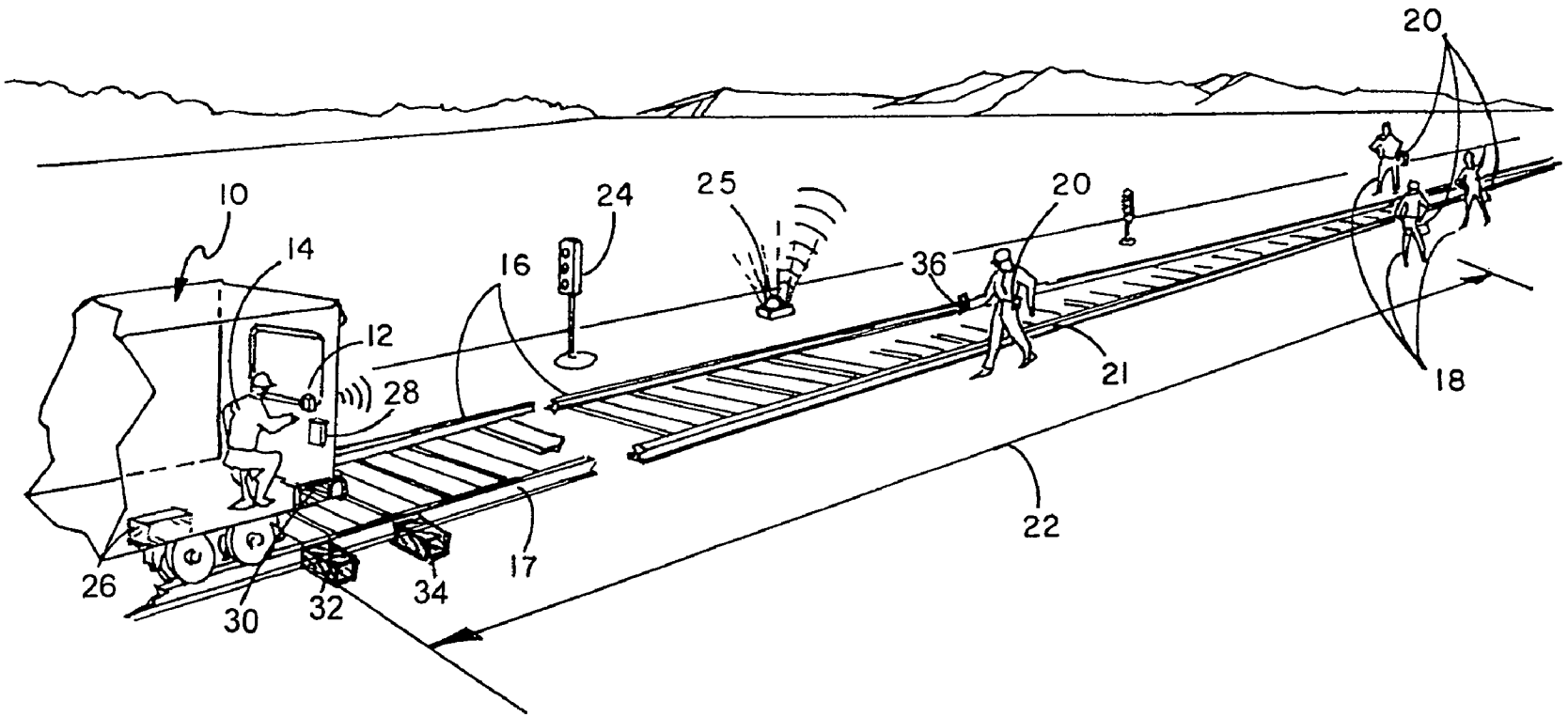
20
18
21
20
22
36
25
24
16
17
34
28
12
32
14
30
10
26

SAFETY SYSTEM FOR RAILROAD PERSONNEL

This application is a continuation-in-part of my prior application entitled Railroad Personnel Safety System for the Protection of Track Workers filed Jun. 19, 2007 Ser. No. 11/820,317, now abandoned, which was a continuation-in-part of my prior application entitled Personal Safety System Kit for the Protection of Track Workers filed Apr. 4, 2007 Ser. No. 11/732,530, now abandoned, which claimed priority and benefit of two provisional patent applications, the first entitled Personal Safety Devices for Both Train Track Workers or Lineman and Train Operators or Vehicle Operator, Ser. No. 60/789,279 filed Apr. 4, 2006, and the second entitled Portable Safety Device for Track Workers "Portable Pro-Tracker", Ser. No. 60/815,425 filed Jun. 21, 2006.

BACKGROUND OF THE INVENTION

1. Field of the Invention

This invention resides in the field of railroad warning systems and more particularly relates to a warning system for train operators, railroad personnel and others working in the vicinity of railroad tracks to give train operators warning of railroad personnel near the train tracks and to give train workers, railroad personnel and others warning of oncoming trains. This invention will also give train operators a display of the specific railroad personnel and others (i.e. first responders, police, firemen, EMS personnel, track walker, track work gangs, track inspectors, other train(s), etc.) as well as in some embodiments giving the train operator early warning of speed restricted areas and of the activation of biological/chemical detectors.

2. Description of the Prior Art

In the fields of light rail vehicle, trolley line, third rail-powered vehicles and tramways, alerting work crews or railroad personnel on or near the tracks of an oncoming train or vehicle, herein referred to as "train," has been addressed by many methods. Because working on tracks can involve work methods such as digging, hammering and other loud-noise producing acts, workers frequently cannot hear oncoming trains and are in great danger of being struck by such oncoming trains. Also, when individuals, such as first responders, police, firemen, EMS personnel, and track inspectors are on the tracks responding to an emergency or incident, they are in great danger of being struck by such oncoming trains. One of the oldest warning methods employs flag men or whistle men who are positioned a distance away from the workers, such as 3,000 ft., 2,000 ft. or a distance related to the stopping distance of a train from a work crew, in both directions of the track who signal with their flags and/or their whistles to warn of oncoming trains. Due to lack of worker attention or distracting ambient noise, work crews sometimes do not see the flag waving or hear the whistle blowing so that these warning methods can often not be reliable. None of the previous or current methods alerts the train operator or gives the train operator exact information of what type of railroad personnel is on the track ahead. Further, none of the previous or current methods gives early alert to first responders, police, firemen, track walkers, track work gangs, and track inspectors that a train is approaching. Moreover, none of the previous or current methods gives the train operator early warning of sharp or dangerous curves or the activation of biological/chemical detectors.

More recently the train operator can receive warnings by radio that workers are on the tracks in the train's vicinity, but frequently because of their poor communication in tunnels and curves and because trains require long distances to stop, such warnings can be ineffective.

Many patents have issued on railroad personnel warning devices, such as U.S. Pat. No. 3,167,282 to S. R. Hursh et. al., which teaches a railroad warning system for warning a work gang working on a railroad track of an approaching train by means of using a train detector physically connected to the track which is activated by having an electrical circuit completed by the pressure of the train's wheels passing thereover. When activated, the device sends a signal to radio receivers and also sets off an audible alarm while at the same time notifying the train operator that a work gang is on the track ahead. This type of system has been improved upon, such as in U.S. Pat. No. 5,924,651 to Penza et. al. where a train transmitter is coupled to a loop buried underneath railroad tracks permanently. Once the train passes over the loop, the warning radio frequency signal can be directed to receivers worn by at least one of the workers in proximity to the railroad tracks to warn such workers of an approaching train in sufficient time to move away from the tracks. Since many workers can wear the portable radio frequency receivers, they do not need to rely upon others nearby to give them notice of the approach of a train. Such pager-like systems can include vibratory alarms which help to notify workers in loud-noise situations. The Penza warning system not only can include portable receivers such as portable paging devices, but also can generate an output signal to activate a visual display, such as flashing lights and the like. The Penza system can utilize a control base positioned near the workers, which base can also receive a signal from a transmitter that is installed within the train or such transmitter can be coupled to a loop buried underneath the railroad tracks to sense when the train is passing by and can send a warning signal in sufficient time for the workers to clear the tracks. U.S. Pat. No. 6,471,162 to Pace provides a system that can be controlled and positioned by workers on the tracks near where they are working to give them advanced notice of an oncoming train. In Pace a train detector probe can be placed near the train tracks at a predetermined distance by the work crew which probe detects an oncoming train and transmits a radio frequency signal to a receiver in the vicinity of the work crew. The system is portable, operating on rechargeable batteries or solar power, and can include multiple warning devices for alerting two or more work crews in a construction zone which has multiple active railway tracks therein. These aforementioned systems do not give early warning to the train operator.

SUMMARY OF THE INVENTION

The present invention provides an improved warning system over those of the prior art not only by warning workers, railroad personnel and others of an oncoming train so that they can safely get off the tracks, but also by alerting the operator of the train of the presence of the other train(s), workers, railroad personnel and others, such as track walkers and the like on the track. In this system the train(s) have a transceiver for sending and receiving signals in the direction of train movement. Each worker and railroad personnel has on his person a personal pocket device (PPD) which has a transmitter/receiver to send signals to an approaching train's transceiver and to receive signals sent by the approaching train's transceiver. The system of this invention operates omni-directionally for the railroad personnel wearing the personal pocket device and directionally for the moving train or vehicle at distances of 2,000 feet or more away from a work zone or location of railroad personnel. In some embodiments of the invention warning lights can be placed on or near the tracks in the vicinity of the workers in the work zone. The transceiver in the train cab operates on electrical current provided either directly from the train or by a battery power supply. The transceiver in the train cab is 4 inches×4 inches×3 inches and has a display letting the train operator know when a specific type of railroad personnel is present on the track or whether a biological/chemical detector has been activated, whether a speed restriction area is ahead, or another train. The personal pocket device carried or worn by the workers and/or railroad personnel is a battery-operated transmitter/receiver which sends and receives signals at 900 MHz and/or 2.5 GHz spread spectrum. Each personal pocket device, being equipped with a receiver, automatically turns on and sounds an alarm once a signal from the transceiver on an approaching train is detected. At the same time the transceiver in the train cab receives a signal from the personal pocket device to cause the transceiver to produce a warning to alert the train operator of the presence of workers and/or railroad personnel on or near the tracks.

In some cases transit police or emergency workers may be unexpectedly on the tracks, for example, pursuing a suspect; and in other cases transit police, firemen, EMS personnel or first responders can also be unexpectedly on a track responding to an accident. Currently one can only protect such workers by means of visual stop lights placed along the tracks to stop oncoming trains or by police radio calls to police dispatchers who have to alert personnel in the train transit control room who then have to alert the train operator, providing they are able to communicate with such train operator. This series of events takes time and often communications can fail when police or first responders are responding to an emergency where time is critical. It is difficult under current practice, for example for transit police to communicate the nature of the emergency to an oncoming train operator to stop such train or to prevent train from entering the next train station. In the present invention by equipping the transceiver on the train with 2-4 frequencies and independent addresses operating at 900 MHz and/or 2.5 GHz spread spectrum and by giving a special personal pocket device (PPD) to transit police, emergency workers and or first responders, it is possible to provide an immediate secure alert to the transit police and/or first responders as well as the train operator of the presence of each other within 2000 ft to give such personnel and train operator sufficient time to react. Such system also can give notice to the train operator of dangerous curves, speed restricted areas and of any dangers present at upcoming train stations, such as another train. Such system further can be used to give warning to train operators that they are entering a train work zone so that they can immediately slow down or stop the train.

In some cases the system of this invention can be utilized with trains that are equipped with vehicle onboard controls (VOBCs). On many trains VOBC systems control the emergency brakes, cab displays and a tag reader. The tag reader on board the train interfaces with a fixed tag that can be installed permanently on or near the track, such as near signal lights, which tag and signal lights are hardwired and positioned in a fixed location. When the train comes near such a signal light that is "red," the tag will electronically sense "red." If the train does not come to a stop at the signal light, the tag reader on the train will send a message to the VOBC that the train is going too fast. The VOBC sends a message to a visual display for the operator to see, and the VOBC also sends a signal, activating the emergency brake to bring the train to a complete stop. The system of this invention can include a portable tag powered by an internal battery which can interact with a VOBC's tag reader to send, when such portable tag is sensed, a warning to the train operator as well as the track workers. Should the train fail to slow down or stop prior to entering the work zone when the portable tag is sensed by the tag reader onboard the train, it will send a signal to the VOBC which then, in turn, sends a signal to the cab display and also activates the emergency brake to slow or stop the train to protect workers or railroad personnel and/or emergency personnel down track. The system thus can provide a fail-safe warning system for track workers which tag can be placed by railroad personnel at the beginning of any work zone or emergency area to not only stop or slow the train, but also provide warnings to the PPDs of track crews and other railroad personnel.

In some instances, especially where trains are not equipped with VOBC controls, the system of this invention can be used with a portable train detector that is attached to the running rail and can detect the presence of a train on the tracks more than 800 feet away and alert personnel not only by signals being sent to their PPDs which they are wearing, but also by activating portable warning lights and horns to give such workers a secondary warning and also to warn the train operator. The portable train detector is battery operated and can be set up to detect trains on the track on which it is installed and in some cases can be set up to detect trains on adjacent tracks, if required. The portable train detector is light and compact in size, being 6 inches high and weighing less than 11 lbs., so as not to allow the unit to be higher than the height of the running rails (tracks).

The system of this invention can include many other safety features, as described further below, including anti-collision means, biological/chemical/radiation detection means, warning alarms, displays and lights, vibration production means, multiple pulsing signals, in order to warn train workers, railroad personnel and others of the approach of a train 2,000 feet from the workers, railroad personnel and others in order to give them sufficient time to move off the tracks. The system also warns the train operator of the presence of train workers, track walker, railroad personnel and/or others on the tracks. Further, this system can provide a warning display to the train operator when anti-collision means and/or biological/chemical/radiation detector has been activated or when other possible areas of danger are ahead, such as sharp curves or speed-restricted areas.

BRIEF DESCRIPTION OF THE DRAWING

The FIGURE illustrates a perspective view of the system of this invention in use, showing railroad workers and others in a work zone and showing a cutaway view of the cab of an approaching train with train operator therein.

DESCRIPTION OF THE PREFERRED EMBODIMENT(S)

The system of this invention enables a train operator to now when he is in close proximity to railroad workers of a work crew, track walkers, another train on the same tracks and others at ranges of up to 2,000 feet or farther. The train(s) has a transceiver that sends signals to activate personal pocket devices worn by the workers to alert the work crew to move away from the oncoming train. Signals received by the train's transceiver from the workers' personal pocket devices alert the train operator of the presence of the work crew or of a track walker on or near the railroad tracks and alert the train operator to immediately take action to slow down the train, sound the train horn alarm, or come to a stop, or take all three actions.

Seen in the FIGURE is oncoming train 10 running on first and second rails 16 and 17. Located in approaching train 10 is transceiver 12 that operates off a battery power supply contained therein or can be powered by the electrical current in train 10. Transceiver 12 sends a signal in 900 MHz and/or 2.5 GHz spread spectrum range to personal pocket devices 20 worn or carried by each worker 18 such as being located on the wearer's upper chest, arm or belt. Personal pocket device 20 can also be worn on an individual track walker 21. Each personal pocket device 20, when it receives a signal from transceiver 12 on train 10, can audibly sound a warning or can vibrate. Not only is the train's presence detected by each personal pocket device 20, but also its speed and direction of movement can be determined and indicated to the workers. Personal pocket devices 20 can be operated by two AAA batteries or by equivalent means. Further, the same signal sent by transceiver 12 can activate portable warning light/horn 25 or fixed warning light 24 which portable warning light/horn 25 can be positioned near the workers in work zone 22, such as near the tracks. The portable warning light/horn 25 can also be set around the work zone at other locations visible to the workers. Portable warning lights 25 can be powered by 24-volt lithium ion rechargeable batteries, and fixed warning lights 24 can be powered by track current. Portable warning light/horn 25 can be positioned at the beginning, middle and/or end of the work area.

The system of this invention utilizes medium range radio frequencies that operate well in hazardous or hard-to-reach areas over long distances such as 2,000 ft. or more. The system of this invention can utilize, in one embodiment, four network frequencies to allow multiple transceivers, one per train, to operate simultaneously in the same area without interference between each system. Personal pocket device 20 is designed to automatically go into a "sleep" mode when it is not activated in order to extend battery life. Personal pocket device 20 can have means to indicate low battery life. It has been found desirable for personal pocket devices 20 to be constructed with internal antennas to eliminate any accidental breakage of extending parts. Train transceiver 12 utilizes unique radio frequency signals and can be equipped with dual contact inputs and dual relay outputs to enable the transceiver not only to transmit signals, but also to receive back confirming signals from the personal pocket devices that such transceiver signals have been received.

Transceiver 12 is installed in the cab of a train in a manner allowing train operator 14 to observe warnings received by signals sent by personal pocket devices 20 that railroad workers 18 and/or track walker 21 are working on the tracks so that train operator 14 can slow down and stop the train or sound a warning to be sure the railroad workers are off the track before proceeding along the track. Transceiver 12 sends and receives a signal frequency of, for example, 2.5 GHz spread spectrum and/or 900 MHz spread spectrum, etc. Transceiver 12 can have a display to indicate when the train is within a given range, such as between 3,000 ft. or closer, to track workers in a work zone. Transceiver 12 can be a dual I/O unit designed to transmit and receive unique signals from personal pocket devices located in the range of 3,000 ft.-2,000 ft. up the track, such distance being a safe train-stopping distance. Both personal pocket devices 20 and transceiver 12 can be equipped with dual contact inputs and dual relay outputs to allow personal pocket devices 20 and transceiver 12 to transmit information out and receive a confirming signal back that their respective signal operations were performed. Transceiver 12 can be equipped with relays to automatically turn on various functions of the train, such as to sound its horn or blink its lights when it has sensed that it is at a closer-than-safe distance from the workers working on the tracks.

In one embodiment of the system of this invention every nearby train operating on a particular railroad line can be equipped with a transceiver 12 that in a preferred embodiment can be small, such as approximately 4 in.×4 in.×3 in. in size and located in an area in the cab in view of the train operator at all times. When a train's transceiver 12 is within 3,000-2,000 ft. of the track workers which is the train's safe-stopping distance, its signals are received by the personal pocket devices of the workers to immediately alert them by means of visual, audible and vibration warning alarms of the danger of the approaching train. In one embodiment of the invention, as the distance between the location of personal pocket devices 20 worn by the track workers and train transceiver 12 becomes shorter, the various visual, audible and vibration alarms can become stronger and more frequent to indicate the urgency of having the workers leave the tracks immediately.

In some instances the system of this invention, as discussed above, can be utilized with vehicle onboard controls 26 (VOBC) which control the emergency brakes on trains such that when tag reader 30 reads the signal of portable tag 32 which is positioned on the track by workers 18, tag reader 30 will send a signal not only to VOBC cab display 28, but also to the PPDs 20 worn by workers 18 and other track personnel not only to warn such workers and the train operator, but also to directly activate the train's braking system should the train fail to slow down or stop so as to slow or stop the train a distance from the work area to protect the work crews and other workers. In situations where the train does not have a VOBC, a portable train detector 34 (PTD) can be attached by clamps to the running rail utilizing rail brackets that can be attached to, or adjacent to, the rail. PTD 34 will sense the presence, speed and direction of the train and send a signal to personnel on the tracks and, in some embodiments, to activate portable warning light/horn 25. PTD 34 is battery operated and operates on the frequencies that are received by the PPDs 20.

The multiple warning system of this invention warns the track workers to step away from a potentially dangerous work area and alerts the train operator to slow down and/or stop the train, thus providing a safe working environment for railroad track workers. In some embodiments a train flagger or track worker can activate or deactivate the system by a hand-held remote control unit 36. The system of this invention can provide an extremely reliable and effective tool for saving the lives of train track workers and emergency personnel.

Although the present invention has been described with reference to particular embodiments, it will be apparent to those skilled in the art that variations and modifications can be substituted therefor without departing from the principles and spirit of the invention.

I claim:

1. A system for use by railroads having a train, tracks, a train operator, track walker, railroad workers, railroad personnel and others, comprising:

warning means for alerting said railroad workers, and railroad personnel and any others working or present near said railroad tracks to the presence of an oncoming train on said railroad tracks and for alerting said train operator of said oncoming train of the presence of such workers, railroad personnel or others on said railroad tracks, said warning means including:

a plurality of personal transmitter/receivers, one of said personal transmitter/receivers for positioning on each of said railroad workers and railroad personnel, said personal transmitter/receivers being battery-operated, said personal transmitter/receivers for receiving signals indicating the presence of an oncoming train, said personal transmitter/receivers providing a perceptible indication to each of said railroad workers of said oncoming train when receiving said signals, each of said personal transmitter/receivers transmitting signals for indicating the presence of train workers working on said railroad tracks;

a train transceiver disposed on said train, said train transceiver viewable by said train operator and railroad personnel, said train transceiver for receiving signals transmitted by each of said personal transmitter/receivers carried by said railroad workers and railroad personnel, said signals from said personal transmitter/receivers indicating the presence of said railroad workers on said railroad tracks, said train transceiver having means to alert said train operator of the presence of said railroad workers, another train, railroad personnel and/or track walkers on or near said train tracks, said train transceiver further including a signal transmission means, said signal transmission means sending signals to any personal transmitter/receivers able to receive said signals to warn said railroad workers and railroad personnel of the presence of an oncoming train on said railroad tracks, said train transceiver signals activating said personal transmitter/receivers to produce said perceptible indication to said railroad workers and railroad personnel for warning them of said oncoming train and at the same time activating any warning lights or horns nearby;

a VOBC and a tag reader disposed on said train;

at least one tag placed by said the railroad workers near said track in advance of said work zone for activating said VOBC and slowing said train when said tag reader on said train reads said tag;

wherein said activated VOBC sends a signal to said transceiver on said train which transceiver notifies said train operator and said railroad workers on said track of said oncoming train.

2. A personnel warning method for use both by railroads having a train, tracks, a train operator, track walker, railroad workers, and railroad personnel, and by others, comprising the steps of:

disposing a plurality of battery-operated personal transmitter/receivers on each of said railroad workers, railroad personnel and/or others, said personal transmitter/receivers receiving and sending signals;

disposing a train transceiver on said train, said train transceiver viewable by said train operator, said train transceiver receiving said signals transmitted by each of said personal transmitter/receivers carried by said railroad workers, track walker, other train(s), railroad personnel and/or others, said signals transmitted by said personal transmitter/receivers indicating the presence of said railroad workers and/or railroad personnel on said railroad tracks, said train transceiver further including signal transmission means, said signal transmission means sending train transceiver signals to any personal transmitter/receivers able to receive said train transceiver signals to warn said railroad workers, track walker and railroad personnel of the presence of an oncoming train on said railroad tracks, said train transceiver signals activating said personal transmitter/receivers to produce a perceptible indication to said railroad workers, railroad personnel and/or others for warning them of said oncoming train;

alerting said railroad workers, track walker, railroad personnel and/or others working on said railroad tracks or in the vicinity of said railroad tracks to the presence of an oncoming train on said railroad tracks, said step including receiving train transceiver signals on said personal transmitter/receivers, said train transceiver signals indicating the presence of an oncoming train, said personal transmitter/receivers providing a perceptible indication to each of said railroad workers, track walker, railroad personnel and/or others of said oncoming train when each of said personal transmitter/receivers receives said train transceiver signals, each of said personal transmitter/receivers transmitting signals to said mounted train transceiver for indicating the presence of railroad workers, railroad personnel and/or others working on said railroad tracks or in the vicinity of said railroad tracks;

alerting said train operator of the presence of said railroad workers, railroad personnel and/or others on said railroad tracks or in the vicinity of said railroad tracks by said train transceiver receiving signals transmitted by at least one of said plurality of said personal transmitter/receivers, said train transceiver producing a perceptible indication for alerting said train operator of the presence of said railroad workers, track walker, railroad personnel and/or others on or near said train tracks;

providing a VOBC and tag reader on said train;

placing a tag near said tracks by said railroad personnel in advance of said work zone for activating said VOBC and stopping said train when said tag reader on said train reads said tag; and sending a signal by said activated VOBC to said transceiver on said train which transceiver then notifies said train operator and further sends a signal to said railroad personnel on said track warning them of said oncoming train.

* * * * *